US005819475A

United States Patent [19]

Momose

[11] Patent Number: 5,819,475

[45] Date of Patent: Oct. 13, 1998

[54] TURNING UP AND DOWN APPARATUS FOR TELESCOPIC TIERED SPECTATOR'S SEATS

[75] Inventor: Michiyoshi Momose, Tokyo, Japan

[73] Assignee: Kabushiki Kaisha Kotobuki, Tokyo, Japan

[21] Appl. No.: 723,221

[22] Filed: Sep. 27, 1996

[30] Foreign Application Priority Data

Sep. 29, 1995 [JP] Japan ..... 7-289113

[51] Int. Cl.[6] ..... E04H 3/12

[52] U.S. Cl. ..... 52/10; 52/9; 297/331

[58] Field of Search ..... 52/10, 6–9; 297/344.1, 297/344.17, 313, 325, 326, 330, DIG. 10, 331–336, 378.1

[56] References Cited

U.S. PATENT DOCUMENTS

| | | | |
|---|---|---|---|
| 4,063,392 | 12/1977 | Ryn et al. | 52/9 |
| 4,155,202 | 5/1979 | Hartman | 52/9 |
| 4,446,659 | 5/1984 | Quigley | 52/9 |
| 4,569,162 | 2/1986 | Suzuki | 52/9 |
| 4,702,043 | 10/1987 | Suzuki et al. | 52/9 |
| 5,271,190 | 12/1993 | Sugiyama | 52/9 X |
| 5,328,238 | 7/1994 | Yamazaki | 52/9 X |
| 5,459,964 | 10/1995 | Dublet | 52/8 |

FOREIGN PATENT DOCUMENTS

| | | |
|---|---|---|
| 59-67452 | 5/1984 | Japan . |
| 5-317137 | 12/1993 | Japan . |

*Primary Examiner*—Beth Aubrey
*Attorney, Agent, or Firm*—Oldham & Oldham Co., L.P.A.

[57] ABSTRACT

To provide a turning up and down apparatus for telescopic tiered spectator's seats capable of preventing the foot members of a chair from being turned down forward, a turning up and down apparatus for telescopic tiered spectator's seats of the present invention is arranged such that the foot members of each of the chairs are pivotally supported at the lower ends thereof so as to rotate about a spindle as a fulcrum, a drive shaft is disposed to which transmitted is the rotation of an output shaft which is rotated by a forward and rearward rotatable motor disposed on each of the platforms, the rotation of the output shaft being reduced through the combination of gear trains, and the front ends of boomerang-shaped links are coupled with the foot members by a foot member coupling pin and the rear ends thereof are supported by a rear end coupling pin, wherein when the foot members are in a turned up state, since the links are pressed against the drive shaft and the center of the rear end coupling pin is located at the position which is determined by getting over the straight line a small angle clockwise which is extended from the center of the foot member coupling pin through the center of the drive shaft, even if an external force for turning down the foot members forward is applied, the turning down thereof forward can be perfectly prevented.

2 Claims, 4 Drawing Sheets

TURNING UP AND DOWN APPARATUS FOR TELESCOPIC TIERED SPECTATOR'S SEATS

BACKGROUND OF THE INVENTION

1. Field of the Invention

The present invention relates to the improvement of a turning up and down apparatus for telescopic tiered spectator's seats (hereinafter, abbreviated as a "turning up and down apparatus" installed in halls, gymnasiums and the like.

2. Description of the Related Arts

Conventional turning up and down apparatuses are arranged such that telescopic spectator's seats, in which a plurality of platforms having seat raising up type chairs installed thereof and arranged in tiers to have a different height are connected to one another to sequentially increase their height, are extended as a whole when the spectator's seats are spread and accommodated in an accommodating space when they are not spread. In the turning up and down apparatus for the chairs, the foot members of the chair are turned up or down by the forward or rearward rotation of a drive shaft and the drive shaft is directly rotated by a motor through a reduction gear (described in Japanese Unexamined Utility Model Publication No. 59-67452).

On the other hand, it is proposed to reduce the rotational speed a motor by a worm and a worm gear provided with each chair through a high rotation low torque drive shaft (described in Japanese Unexamined Patent Publication No. 5-317137).

When speed reduction is directly carried out from the motor through the reduction gear, power is transmitted at low rotation and high torque. Thus, when a number of chairs are operably connected to one another, a drive shaft is twisted and a phase difference or a power loss is caused between a chair located near to the motor and a chair spaced apart from the motor. Further, when the rotational speed of the motor is reduced through the reduction gear, a large reduction ratio must be taken. For example, in a 4-pole motor operated at 60 Hz, the rotational speed of 1800 rpm is reduced to 1/200 of it in the motor and the resultant rotational speed is reduced to 1/2.8 of it by a power unit gear portion, that is, the original rotational speed is reduced to 3.21 rpm of it by the total reduction ratio of 1/560, and when the motor is operated at 50 Hz, the rotational speed of 1500 rpm is reduced to 1/200 of it in the motor and the resultant rotational speed is reduced 1/2.8 of it by the power unit gear portion, that is, the original rotational speed is reduced to 2.68 rpm by the total reduction ratio of 1/560 and there is provided a toggle link mechanism for preventing the rotation of the chairs. As a result, since a turning up and down apparatus including a drive unit composed of the motor, the reduction gear and the like and the toggle link mechanism requires a considerable space, if the space can be reduced, the number of spectator's seats can be increased when they are spread and an accommodating volume can be reduced when the spectator's seats are accommodated.

On the other hand, when the rotational speed of the motor is reduced by the worm and the worm gear provided with each chair through the high rotation low torque drive shaft, although a phase difference caused by the twist of the drive shaft is reduced, a large power loss is caused by a low power transmission efficiency achieved by the worm and the worm gear.

An object of the present invention is to provide a compact turning up and down apparatus capable of saving energy and space and lowering cost by solving the above problems.

SUMMARY OF THE INVENTION

A turning up and down apparatus for telescopic tiered spectator's seats of the present invention is arranged such that the foot members of each of the chairs are pivotally supported at the lower ends thereof so as to rotate about a spindle as a fulcrum, a drive shaft is disposed to which transmitted is the rotation of an output shaft which is rotated by a forward and rearward rotatable motor disposed on each of the platforms, the rotation of the output shaft being reduced through the combination of gear trains, and the front ends of boomerang-shaped links are coupled with the foot members by a foot member coupling pin and the rear ends thereof are supported by a rear end coupling pin, wherein when the foot members are in a turned up state, since the links are pressed against the drive shaft and the center of the rear end coupling pin is located at the position which is determined by getting over the straight line a small angle clockwise which is extended from the center of the foot member coupling pin through the center of the drive shaft, even if an external force for turning down the foot members forward is applied, the turning down thereof forward can be perfectly prevented.

DESCRIPTION OF THE PREFERRED EMBODIMENT

An embodiment of the present invention will be described with reference to drawings.

Although FIG. 1 to FIG. 4 do not show chairs and components located in the vicinity thereof, a plurality of platforms of telescopic tiered spectator's seats, which have seat raising up type chairs installed thereon and are arranged in tiers to have a different height, are operably connected to one another to sequentially increase their height and seat raising up type chairs are installed on the platform in each tier, each of the platforms being arranged to extend forward and contract rearward. A plurality of the chairs each having a seat are disposed adjacent to one another in a lateral line with intervals therebetween in the right to left direction on the upper surface of each platform on the side near to the rear end thereof and a turning up and down apparatus 1 is disposed in correspondence to each chair.

The turning up and down apparatus 1 and a drive unit 8 will be described below.

Figure 1:
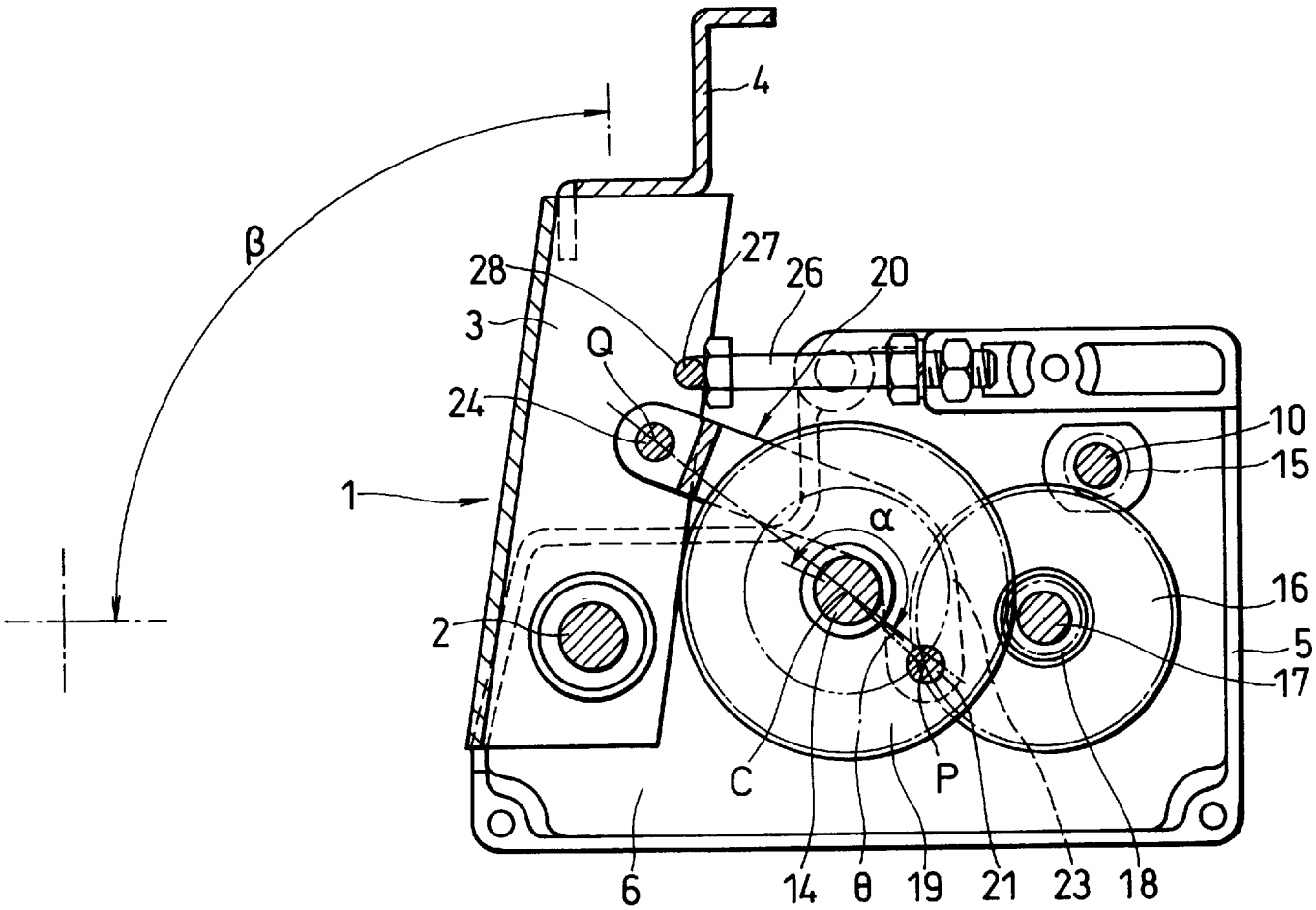
FIG. 1 is a schematic side elevational view explaining an embodiment of a turning up and down unit used to a turning up and down apparatus for telescopic tiered spectator's seats according to the present invention in a turned up state.
Figure 2:
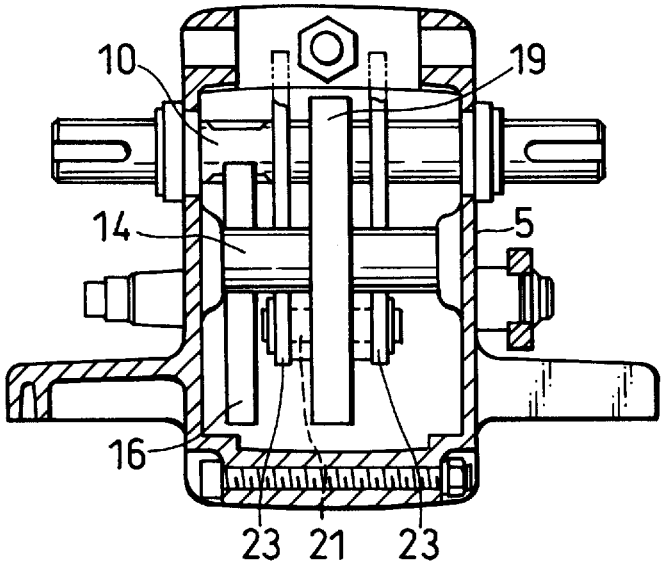
FIG. 2 is a schematic front elevational view explaining the turning up and down unit of FIG. 1.
Figure 3:
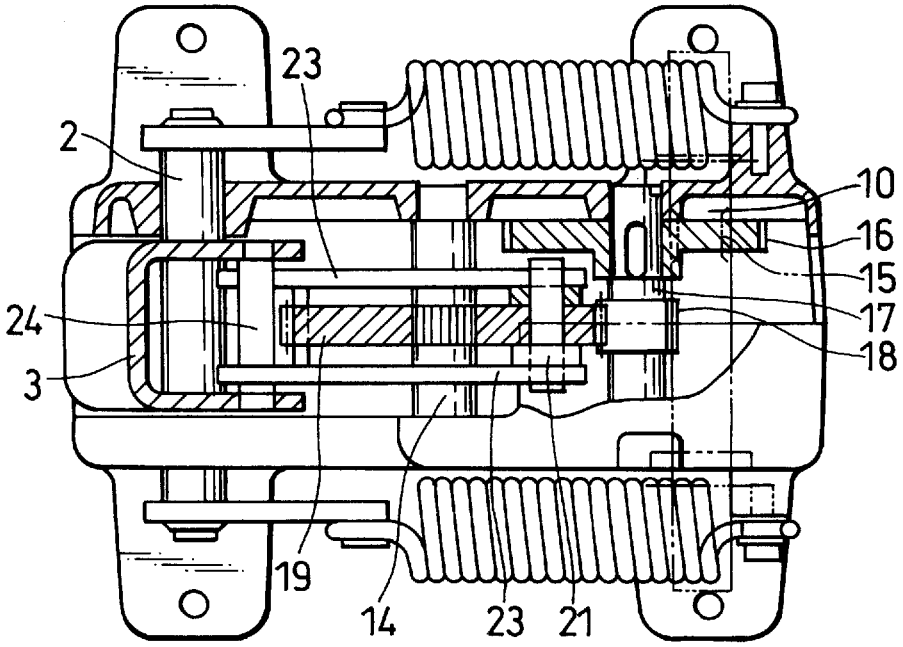
FIG. 3 is a schematic plan view of the turning up and down unit of FIG. 1.
Figure 4:
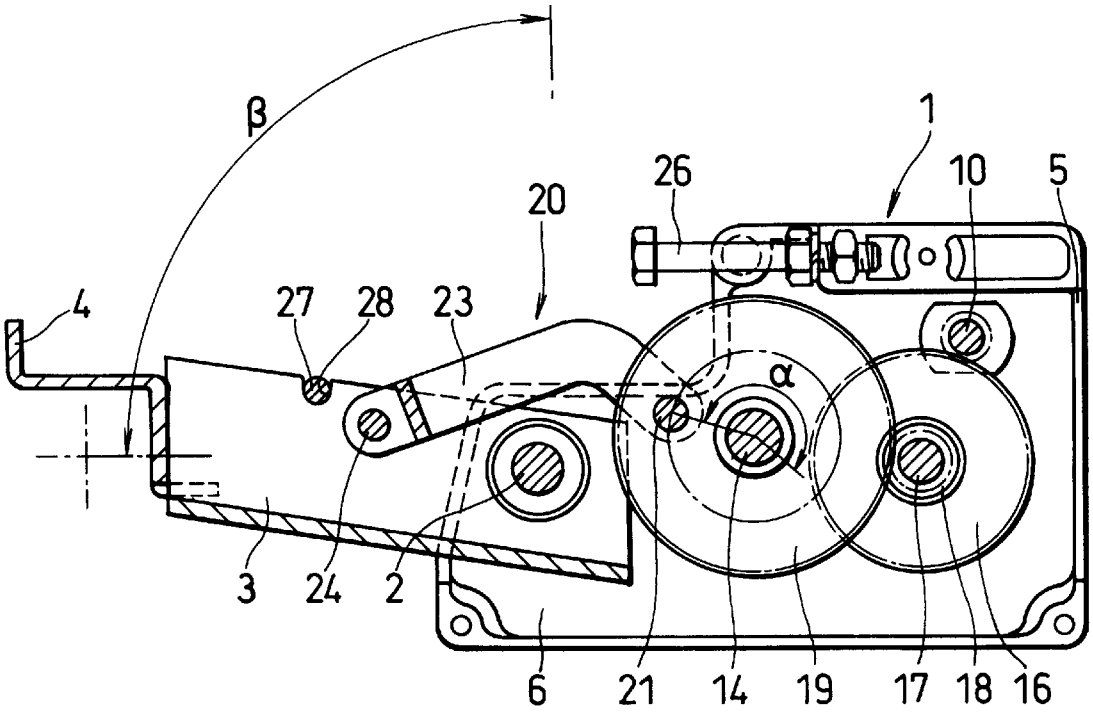
FIG. 4 is a schematic side elevational view of the turning up and down unit of FIG. 1 in a turned down state.
Figure 5:
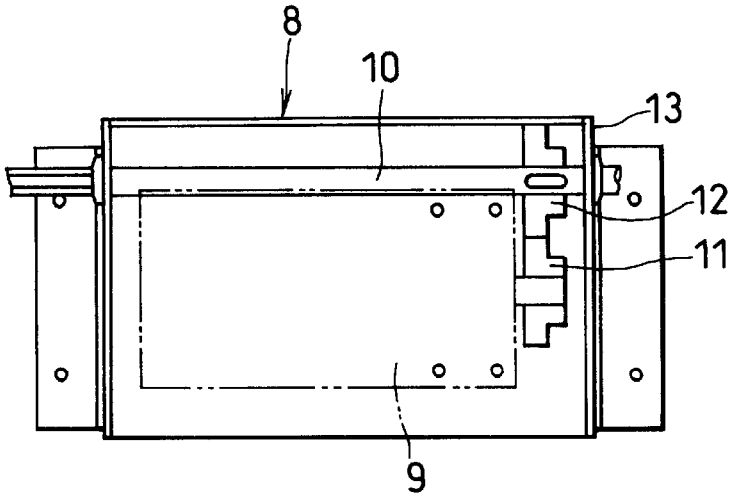
FIG. 5 is a schematic front elevational view explaining an embodiment of a drive unit used in the turning up and down apparatus for telescopic tiered spectator's seats according to the present invention.
Figure 6:
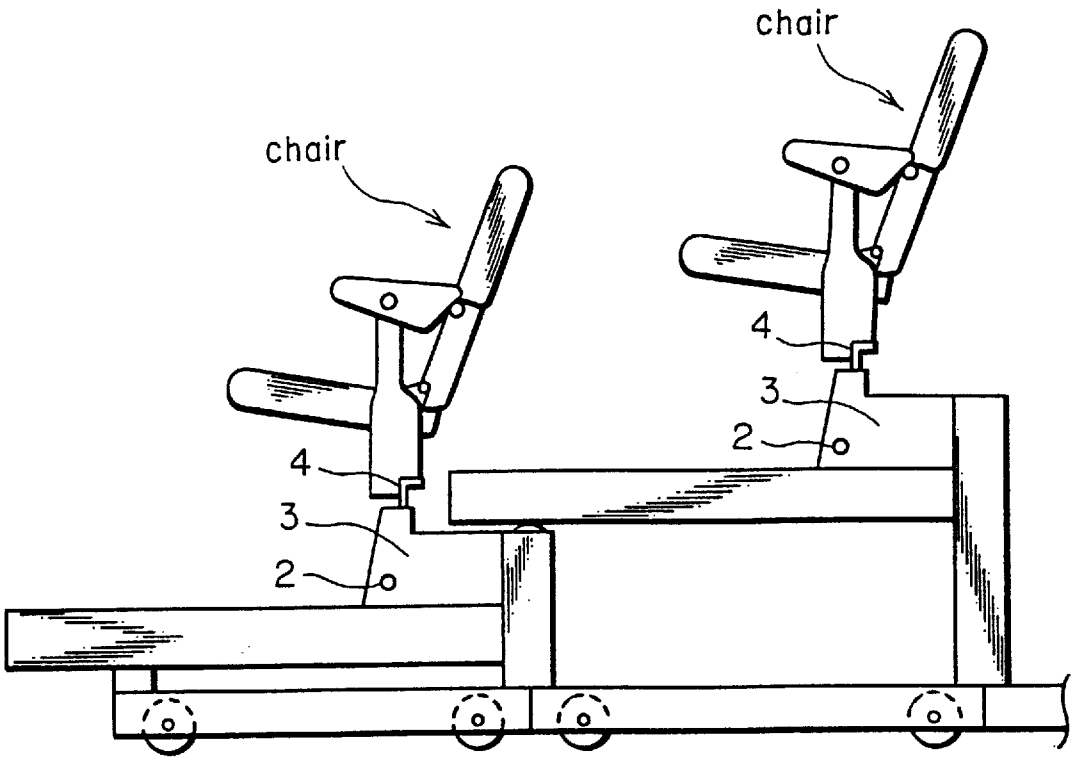
FIG. 6 is a schematic side elevational view of the turning up and down apparatus for telescopic tiered spectator's seats in accordance with a preferred embodiment of the present invention.

As shown in FIG. 5, the drive unit 8 is mounted in a fixed frame 13 as a unit as a whole in such an arrangement that a geared motor 9 with a brake rotatable forward and rearward is disposed in the fixed frame 13 and an output shaft 10 coupled with the shaft of the motor 9 through spur gears 11, 12 is pivotally supported by bearings at the both ends thereof. The rotation of the geared motor 9 is transmitted to the output shaft 10 through the spur gears 11 and 12 so that it is rotated forward and rearward.

The turning up and down apparatus 1 includes foot members 3 fixed to and standing from a spindle 2, a passing-through bar 4 fixed to the upper ends of the foot members 3 and disposed laterally and a turning up and down chair fixed to and standing from the passing-through bar 4 at the respective lower ends thereof in a lengthwise direction from the right to the left with intervals therebetween. The chair is composed of support legs, a seat, arms and a back (the chair is not shown in the drawings).

The foot members 3 are pivotally mounted to rotate a rotational angle β (usually 90°) using the spindle 2 of the turning up and down unit 1 as a fulcrum, respectively, so that the chair on the foot members 3 can be turned up and down as a whole. That is, a lateral decorated box 6 which is long in the right to left direction is disposed on the upper surface of the platform at the rear portion thereof and the turning up and down unit 1 having the spindle 2 is fixedly disposed with intervals on the right and left sides thereof so as to be accommodated in the decorated box 6.

The output shaft 10 projects from the drive unit 8 to both the right and left directions or to any one of the right and left directions and introduced into the turning up and down unit 1.

The turning up and down unit 1 has respective gear trains arranged such that the output shaft 10 rotatably passes through the box-shaped fixed frame 5 of the decorated box 6 on the upper rear portion thereof in the right to left direction, the rotational speed of the output shaft 10 is reduced in a first stage through the small gear 15 fixedly mounted to the output shaft 10 and a large gear 16 and further reduced in a second stage through the small gear 18 fixedly mounted to the gear shaft 17 of the large gear 16 and the large gear 19 fixedly mounted to a drive shaft 14 located approximately at the center of the fixed frame 5.

The spindle 2 is laterally disposed in the right to left direction at a front lower portion of the drive shaft 14 and rotatably supports the foot members 3 at the lower ends thereof at positions spaced apart from each other and a turning up and down mechanism 20 is disposed in the fixed frame 5 which rotates the foot members 3 the aforesaid rotational angle β (usually 90°) about the spindle 2 to thereby turn up or down the foot members 3 as the drive shaft 14 rotates a rotational angle α forward and rearward.

The turning up and down mechanism 20 is composed of a pair of right and left boomerang-shaped links 23, 23 supported by a foot member coupling pin 24 at the front end thereof which passes through the foot members 3 at a position thereof a little higher than the intermediate position in the vertical direction of the foot members 3 and a rear end coupling pin 21 at the rear end thereof which passes through the large gear 19 integrally mounted to the drive shaft 14 at a position near to the end of the gear 19 to thereby couple the rear end coupling pin 21 of the large gear 19 which is rotated by the forward and rearward rotation of the drive shaft 14 with the foot member coupling pin 24. With this arrangement, the large gear 19 is rotated forward and rearward the rotational angle α by the forward and rearward rotation of the drive shaft 14 integrally therewith and the links 23, 23 are pushed out forward or pulled in rearward by the rotation of the large gear 19, so that the foot members 3 are rotated the rotational angle β (usually 90°) about the spindle 2 as a fulcrum and can be turned up or down.

When the foot members 3 are in a turned up state, the boomerang-shaped links 23, 23 press the drive shaft 14 by riding over it and at the time the center P of the rear end coupling pin 21 is located at the position which is determined by getting over the straight line an angle θ clockwise which is extended from the center Q of the foot member coupling pin 24 through the center C of the drive shaft 14. Thus, even if an external force for turning down the foot members 3 forward is applied, the turning down thereof 3 forward can be perfectly prevented unless the drive shaft 14 is rotated counterclockwise.

Since the rear end coupling pin 21 is mounted to the large gear 19 by being passed therethrough, the apparatus can be made compact. Further, a degree of freedom in design can be increased by changing the position where the rear end coupling pin 21 is mounted.

The fine adjustment of the angle θ between the line QC and the line CP is made possible by such an arrangement that adjusting bolts 26 finely adjustable forward and rearward are disposed on the upper portion plate of the fixed frame 5 and stoppers 27 fixed to the grooves 28 defined to the turning up foot members 3 by welding or the like serve to determine stop positions and the adjusting bolts 26 are finely adjusted forward and rearward.

Although the rotational speed of the output shaft 10 transmitted from the motor 9 being rotated is reduced by the combination of the gear trains composed of the small gears and the large gears as described above, the rotational speed is transmitted to the drive shaft 14 by being reduced to a final rotational speed preferably in the two stages of the small and large gear trains such as the gear trains composed of, for example, the gears 15, 16 and the gears 18, 19. As a result, the volume of the motor 9 can be reduced, the diameter of the output shaft 10 can be reduced due to the power transmission at high rotation and low torque, a phase difference and a power loss caused by twist can be removed and the turning up and down apparatus can save energy and space and lower cost. Further, a less amount of power loss is caused because the rotational speed is reduced by the gear trains in place of a worm and worm gear, thus energy can be saved.

As a specific example, the rotational speed of a geared motor used as the motor 9 is transmitted to the output shaft 10 by being reduced to 1/30 of it, the numbers of the teeth of the gears 15, 16, 18, 19 of the gear trains are set to 16, 74, 14 and 62 to thereby reduce the rotational speed of the drive shaft 14 to 1/20.482 of that of the output shaft 10 and the speed reduction ratio of the rotational speed to be transmitted from the motor 9 to the drive shaft 14 is set to 1/614.46.

Further, when the foot members 3 have the rotational angle β of 90°, the rotational angle α of the drive shaft 14 when it is rotated forward and rearward (which is the same as the rotational angle of the large gear 9 when it is rotated forward and rearward) is set to 200°.

According to the present invention, when the foot members are in a turned up state, since the links are pressed against the drive shaft and the center of the rear end coupling pin is located at the position which is determined by getting over the straight line a small angle clockwise which is extended from the center of the foot member coupling pin through the center of the drive shaft, even if an external force for turning down the foot members forward is applied, the turning down thereof forward can be perfectly prevented.

Further, the rear end coupling pin is mounted to the large gear by being passed through, the apparatus can be made compact.

What is claimed is:

1. A turning up and down apparatus for telescopic tiered spectator's seats in which platforms each having a plurality of chairs installed thereon are operably connected to one another to sequentially increase their height in tiers and disposed to be extendable forward and contractible rearward, comprising a plurality of foot members having upper ends and lower ends, said foot members supported from a spindle so as to rotate about said spindle as a fulcrum, said spindle being fixedly disposed in a box, a passing-through bar fixed to said upper ends of said foot members, a turning up and down chair supported from said passing-through bar, a motor having an outwardly extending shaft rotatable in a forward direction and a rearward direction, said motor is disposed in a fixed frame, an output shaft coupled with said outwardly extending shaft of said motor, a drive shaft to which the rotational speed of said output shaft is transmitted through a combination of gear trains, the rotation of said output shaft being reduced through said combination of gear trains, and boomerang-shaped links having a front end and a rear end, the front ends of the links are coupled with said foot members by a foot member coupling pin and the rear ends thereof are supported by a rear end coupling pin which is mounted to a large gear driven by said output shaft, wherein when said foot members are in a turned up state, since said links are pressed against said drive shaft and the center of said rear end coupling pin is located at the position which is determined by getting over the straight line a small angle clockwise which is extended from the center of said foot member coupling pin through the center of said drive shaft, even if an external force for turning down said foot members forward is applied, the turning down thereof forward can be perfectly prevented.

2. The turning up and down apparatus for telescopic tiered spectator's seats according to claim 1, wherein the rotational speed of said output shaft is transmitted to said drive shaft through said combination of gear trains composed of small and large gears and arranged in two stages.

* * * * *